US005340132A

United States Patent [19]

Malewicz

[11] Patent Number: 5,340,132

[45] Date of Patent: Aug. 23, 1994

[54] TORSIONALLY STIFFENED IN-LINE ROLLER SKATE FRAME WITH DUAL SIDE WALLS

[75] Inventor: Andrzej M. Malewicz, Minneapolis, Minn.

[73] Assignee: Rollerblade, Inc., Minneapolis, Minn.

[21] Appl. No.: 23,136

[22] Filed: Feb. 24, 1993

Related U.S. Application Data

[63] Continuation of Ser. No. 714,837, Jun. 13, 1991, abandoned.

[51] Int. Cl.[5] ..... A63C 17/14

[52] U.S. Cl. ..... 280/11.22; 280/11.3

[58] Field of Search ..... 280/11.22, 11.23, 11.19, 280/11.17, 11.18, 11.3, 11.12, 11.26, 842, 843, 281.1, 281.3, 281.4; 18/311

[56] References Cited

U.S. PATENT DOCUMENTS

| | | | |
|---|---|---|---|
| D. 264,612 | 5/1982 | Szegi | D21/226 |
| D. 305,560 | 1/1990 | Hoshizaki et al. | D21/225 |
| 678,402 | 7/1901 | Jones | 280/11.17 |
| 2,145,219 | 1/1939 | Burton | 280/11.22 |
| 2,220,557 | 11/1940 | User | 280/11.22 |
| 2,644,692 | 7/1953 | Kahlert | 280/11.22 |
| 3,287,023 | 11/1966 | Ware | 280/11.22 |
| 3,387,852 | 6/1968 | De Sarro | 280/11.22 |
| 3,877,710 | 4/1975 | Nyitrai | 280/11.23 |
| 3,902,692 | 9/1975 | Skinner | 248/346 |
| 3,993,318 | 11/1976 | Rothmayer | 280/11.26 |
| 4,008,901 | 2/1977 | Conn | 280/7.13 |
| 4,058,324 | 11/1977 | Dallaire | 280/11.22 |
| 4,088,335 | 5/1978 | Norton et al. | 280/11.18 |
| 4,351,537 | 9/1982 | Seidel | 280/11.12 |
| 4,492,385 | 1/1985 | Olson | 280/7.13 |
| 4,618,158 | 10/1986 | Liberkowski | 280/11.26 |
| 4,826,183 | 5/1989 | Bratland et al. | 280/11.22 |
| 4,835,885 | 6/1989 | Hoshizaki et al. | 36/115 |
| 4,909,523 | 3/1990 | Olson | 280/11.22 |
| 5,046,746 | 9/1991 | Gierveld | 280/11.22 |
| 5,092,614 | 3/1992 | Malewicz | 280/11.22 |

FOREIGN PATENT DOCUMENTS

| | | | |
|---|---|---|---|
| 0379906 | 8/1990 | European Pat. Off. . | |
| 2304853 | 8/1974 | Fed. Rep. of Germany . | |
| 2566672 | 6/1984 | France . | |
| 8700023 | 4/1988 | Netherlands | 280/11.12 |
| 8911894 | 12/1989 | PCT Int'l Appl. . | |
| 6160 | of 1884 | United Kingdom . | |
| 400436 | 10/1933 | United Kingdom . | |
| 1402028 | 8/1975 | United Kingdom . | |

*Primary Examiner*—David M. Mitchell

*Attorney, Agent, or Firm*—Merchant, Gould, Smith, Edell, Welter & Schmidt

[57] ABSTRACT

The present invention provides a torsionally stiffened, in-line roller skate frame having dual side walls having particular application to competitive speed skating. The frame is attachable to a skate boot and mounts a plurality of wheels for rotation in a common plane. A frame embodying the present invention includes first and second longitudinally extending side rails, each having first and second walls and each strengthened to resist skating generated twisting forces by reinforcing members extending between the first walls of the side rails and reinforcing members that extend between the first and second walls of each side rail. Each side rail includes a contoured wall portion and a planar wall portion. Preferably the frame is made of a graphite filled nylon material.

55 Claims, 3 Drawing Sheets

TORSIONALLY STIFFENED IN-LINE ROLLER SKATE FRAME WITH DUAL SIDE WALLS

This is a continuation of application Ser. No. 07/714,837, filed Jun. 13, 1991, and now abandoned.

The present invention relates to in-line roller skate frames, and in particular to frames used in speed skating applications.

BACKGROUND OF THE PRESENT INVENTION

In-line roller skating is a fast growing, recreational activity. Growing along with that skating activity of the general population is speed skating wherein competitors race against each other and the clock. In-line competitive speed skating has reached a popularity level where it is scheduled to be a trial event at the 1992 Olympics to be held in Barcelona, Spain.

To build an effective speed skate requires a delicate compromise between lightweight and necessary strength to achieve torsional stiffness. Skate frame weight should be minimized since a lighter skate is easier for the speed skater to carry, and the skater expends less energy in simply carrying the skate during a race. The weight should not be reduced, however, at the expense of creating a frame that twists, bends or deforms easily as a result of skating forces generated as a result of a skating stride. Any bending, twisting or other deformation of the frame from its static position results in an energy loss that could otherwise be converted into forward momentum of the skater. All such bending, twisting or other deformation of the frame absorbs energy that the skater would otherwise utilize to propel himself. Accordingly, minimizing the weight of the frame is desirable, but only if it can be done without reducing the torsional stiffness of the frame so much as to make the frame susceptible to substantial bending, twisting or other deformation.

At least two related competitive advantages can be realized by creating a skate frame that has a reduced weight over known frames. First, a lighter frame is easier for the skater to wear and particularly so during a long race. Second, as the frame is lightened and stiffened due to new structure and material composition, it is possible to make a long racing frame while still weighing less than recreational frames. A longer frame creates a greater stroke advantage with each skating stride, and thus creates a faster, more efficient skate.

The skate frame typically used by racers is generally longer than recreational skates—12½ to 13½ inches from front axle center to rear axle center typically—and carries five wheels instead of the three to four wheels used with recreational skates. In general, two types of racing skate frames are presently being used. One utilizes an aluminum frame having a U-shaped cross section. Another type of frame now used has a U-channel made of laminated carbon fabrics impregnated with resin. With both the aluminum and the laminated frames, the weight of a single frame is of the order of 8½ ounces. By contrast, lighter weight commercially available synthetic frames for recreational use are now typically made out of a lightweight glass fiber reinforced nylon material. One such frame, manufactured by the assignee of the present invention, weighs less than 7 ounces but while rotatably supporting only four wheels. Many recreational frames lack sufficient torsional stiffness to resist undesirable twisting during racing. To provide resistance to twisting, current teachings in the art would call for increasing the thickness of the side rails, resulting is an undesirable increase in the frame weight, or for providing thicker supports between opposing frame side walls, or both, but again requiring an undesirable weight increase.

Accordingly, some of the currently available racing frames resist some twisting and deformation due to skating generated forces, but they do so at the expense of utilizing materials that are heavier than the materials used in recreational skates. Thus, it would be desirable to provide a racing skate frame made of a light weight synthetic material but not at the expense of losing the stiffness of the frame. The present invention achieves a merging of synthetic material with a structurally thin but effectively reinforced lightweight frame structure so as to achieve a fast, strong and highly rigid racing frame that is less susceptible to energy inefficient deformations.

SUMMARY OF THE PRESENT INVENTION

The present invention provides a frame for an in-line roller skate and a skate having such a frame that is particularly designed for racing but whose teachings are useable with most in-line skate frames. The frame of the present invention is made of a one piece, injection molded synthetic material such as a thirty percent graphite filled nylon. The frame includes a plurality of axle aperture pairs disposed near the bottom edge of the frame, each aperture pair receiving a wheel axle for rotatably mounting a wheel with all of the wheels rotating in a common plane. A frame embodying the present invention includes first and second substantially parallel, longitudinally extending side rails that have a substantially symmetrical configuration about a longitudinally extending vertical plane and also includes a boot for attaching the frame to the foot of the skater and inter-rail support means providing torsional stiffness. The inter-rail support means extend between the side rails between adjacent wheels. Each inter-rail support means comprises mutually intersecting, interacting, reinforcing cross-ribbing members having substantially an X-shape, which act to resist twisting of the frame by strengthening the frame and distributing skating generated twisting forces throughout the frame.

In a preferred embodiment, the cross-ribbing has a cross sectional configuration substantially similar to two "V"s whose vertices are joined by a short, straight connective member, the straight member assuring necessary wheel clearances to adjacent wheels. That is, the cross-ribbing comprises a first pair of riblets extending from a first side rail toward the second side rail with the riblets converging to form a first vertex; a second pair of riblets extend from the second side rail toward the first side rail with the riblets of the second pair converging to form a second vertex; a connecting member joins the two vertices.

Each of the side rails of a frame in accordance with the present invention includes first and second frame walls and a plurality of webs extending therebetween, with the previously mentioned cross-ribbing members extending between the walls of the side rails. The first walls of the side rails have a substantially planar configuration. The second walls of the side rails have a substantially contoured or curvilinear configuration and engage the sole of the boot. The contoured second wall extends from the top edge of the frame downwardly approximately to the top of the axle apertures used to mount the wheels to the frame.

The described frame result in a greatly improved racing skate having low weight, significantly improved torsional stiffness, durability, and high performance racing characteristics.

These and other advantages of the invention will become apparent to those skilled in the art when the following detailed description of the invention is read in conjunction with the accompanying drawings and claims. Throughout the drawings, like reference numerals refer to similar or identical parts.

DETAILED DESCRIPTION OF THE PRESENT INVENTION

Figure 1:
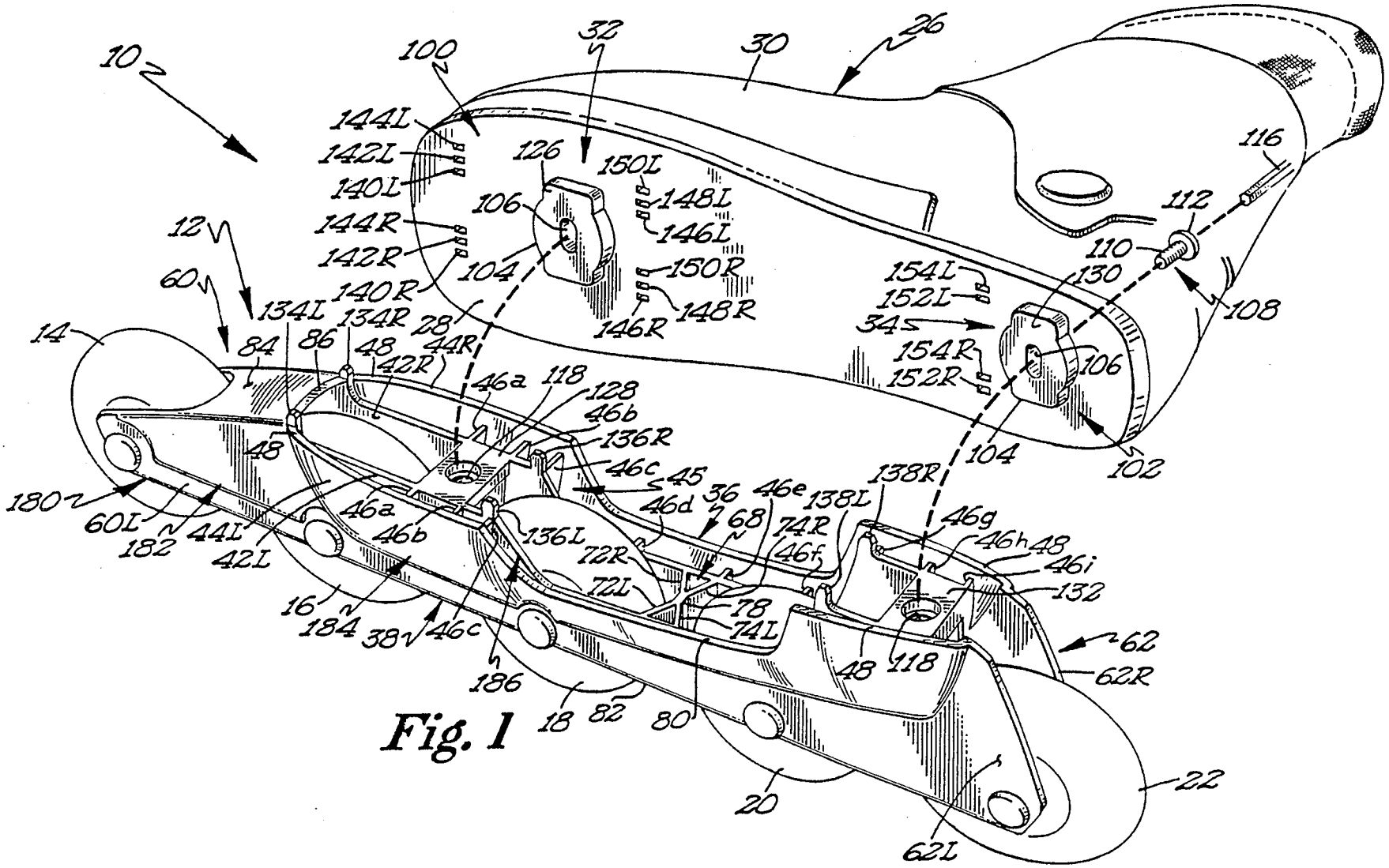
FIG. 1 is an exploded, side perspective view of an in-line roller skate embodying the invention and showing the boot exploded upwardly away from the frame and tipped sidewardly to reveal the boot sole and the top of the skate frame.
Figure 2:
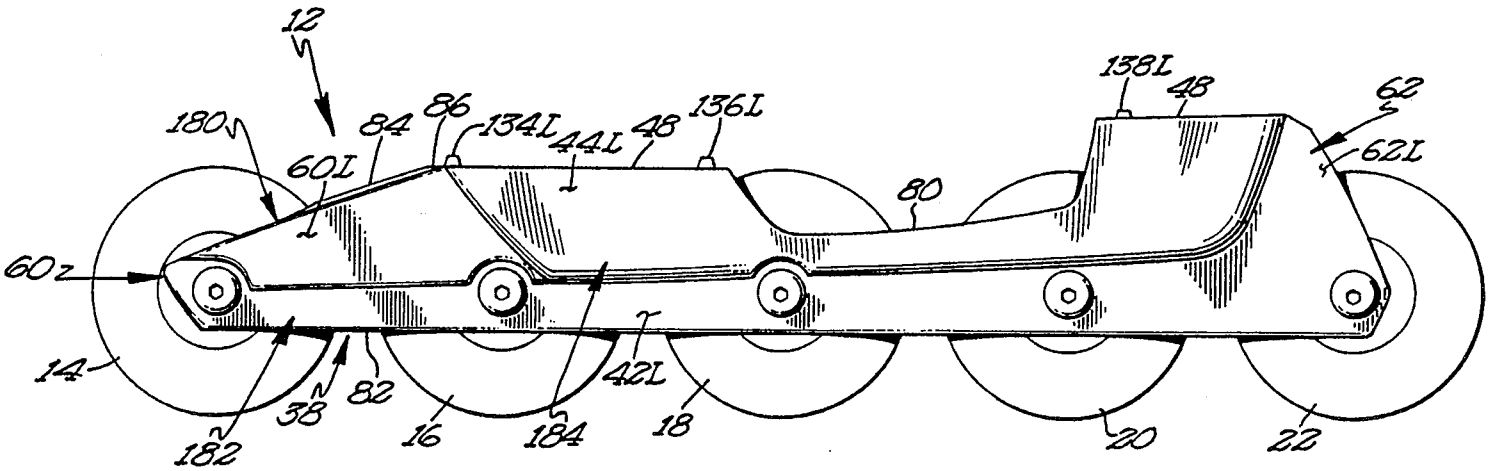
FIG. 2 is a side elevation view of the frame of FIG. 1.
Figure 3:
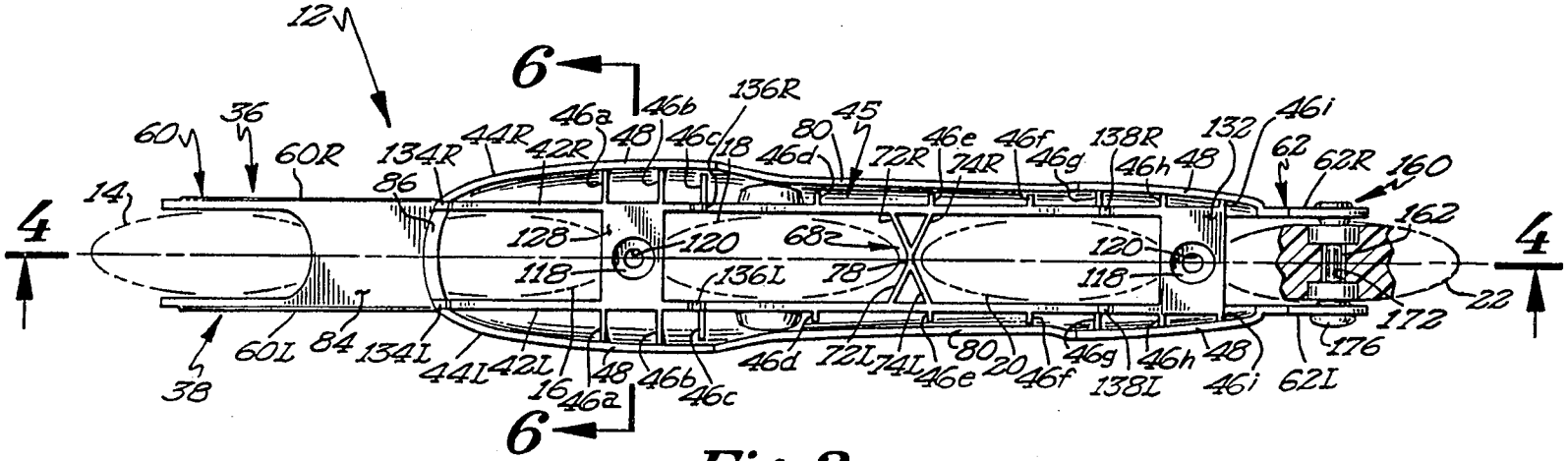
FIG. 3 is a top plan view of the frame of FIG. 1.

Referring now to FIG. 1, an in-line roller skate 10 includes a frame 12 mounting a plurality of wheels 14, 16, 18, 20, and 22 for rotation within a common plane 40 (FIG. 3). Skate 10 further includes a boot 26 or the like, which provides a means for attaching the frame 12 to a skater's lower limb. Boot 26 includes a boot sole 28 and a boot upper 30. The term, boot, as used herein connotes footwear in general and includes boots or shoes having low or high tops and made of leather, cloth, a synthetic material, or other known material. In a preferred embodiment, frame 12 is attached to sole 28 at front and rear sole attachments 32 and 34 to be described further below.

Frame 12 is preferably manufactured of a carbon or graphite-filled, plastic-like, synthetic material such as nylon, a 30% graphite filled nylon being preferred, though a range of graphite filling is within the purview of the present invention. While frames manufactured of synthetic materials are known in the art, such frames have not been used previously for a racing frame because they tended to twist under the loads experienced during racing and therefore were inefficient to use. As noted, such frames could have been made stiff enough by increasing the thickness of the wall structures, however, this would have resulted in a weight far in excess of that presently achievable with either aluminum or laminated skate frames. Thus, the use of an all synthetic frame in a racing application is new to the art.

Referring now to FIGS. 1–5, the frame 12 includes first and second longitudinally extending side rails 36 and 38 symmetrically disposed about a longitudinally extending vertical symmetry plane 40 (FIG. 3). Wheels 14–22 are rotatably mounted therebetween as described further hereafter. It will be understood that the description of the side rails as being "first" and "second" is for convenience only since as constituted frame 12 is attachable to either a left or a right boot and thus either side rail may form a rail positioned on the inside or the outside of a skater's foot. It will also be understood that because the frame shown has a mirror image symmetry about plane 40 that a feature found on one side wall will also be found on the other side wall and that a description of the former will describe the latter. Thus, generally throughout the specification, a frame feature described and referenced by a numeral will have left and right counterparts and thus will be designated on the drawings with an "L" or an "R" added to the numeral.

Side rails 36 and 38 each include a planar wall 42 and a contoured wall 44. Contoured wall 44 is integral along its lower edge with the planar wall 42 and diverges upwardly and outwardly therefrom to define a channel 45 therebetween. Planar wall 42 extends the entire length of frame 12 whereas contoured wall 44 generally extends only the length of the boot 26. In other words, planar wall 42 extends both rearwardly and forwardly of boot 26 when frame 12 is attached thereto whereas contoured wall 44 is disposed substantially directly under boot 26 in engagement with sole 28 thereof and generally does not extend rearwardly or forwardly of boot 26.

Contoured wall 44 is generally symmetric with respect to plane 40. A plurality of webs **46*a*–46*i* extend within channel 45 between planar and contoured walls 42 and 44. Webs 46*a*–46*i* support and strengthen contoured wall 44 and inhibit twisting of the frame 12 due to skating generated forces. Webs 46*a*–46*i* intersect and extend between walls 42 and 44 although certain of them, web 46*e*, for example, may appear to be separate from contoured wall 44 due to the curvature of the walls 44**.

As best seen in FIGS. 1–4, contoured wall 44 has a top edge 48 that forms the top edge of frame 12. Top edge 48 engages boot sole 28 at front and rear attachment pedestals 32 and 34, respectively. Contoured wall 44 lies outside of planar wall 42, as best seen in FIG. 3 and thus also provides a broad support base for boot 26.

Contoured wall 44 extends from top edge 48 downwardly to approximately the height of the pairs of axle apertures 50, 52, 54, 56 and 58. Each axle aperture pair includes a right and a left aperture respectively disposed in right and left side rails 36 and 38. Axle apertures 50–58 may each receive an axle aperture plug having an eccentrically disposed axle bore as described in U.S. patent application Ser. No. 07/057,056, assigned to the same assignee as the present invention. Reference may be made to that application for a complete description of the axle aperture plugs and how they function to enable the skater to attach the wheels to the frame at selected heights relative to one another and to the frame. Axle apertures having a circular configuration or a configuration other than the oval configuration shown are also within the purview of the present invention, however.

Each planar wall 42 includes front and rear fenders 60 and 62, respectively. Front fender 60 slopes downward along its top edge from the rear toward the front thereof. Each fender includes an axle aperture. Thus, axle aperture pair 50 is disposed in front fenders 60L and 60R while axle aperture pair 58 is disposed in rear fenders 62L and 62R. Aperture pair 50 is used to mount front wheel 14 and is disposed such that wheel 14 is disposed entirely forwardly of boot 26. Aperture pair 58 is disposed on rear fenders 62L and 62R such that the axis of rotation of rear wheel 22 lies rearwardly of boot 26.

Stated again, each side rail 36, 38 includes an outer wall 180 having planar and contoured portions 182 and 184, respectively, and an inner wall 186 having only a planar configuration. Inner wall 186 is completely enclosed by outer wall 180 and is integral therewith at the juncture of planar and contoured portions 182 and 184 and extends upwardly therefrom. Inner wall 186 and outer wall planar portion 182 are coplanar. Inner wall 186 comprises an additional intersecting planar member that cooperates with a plurality of cross-ribbing members, such as members 66, 68, and 70, to be discussed hereafter to torsionally stiffen the frame to resist skating generated forces.

Figure 5:
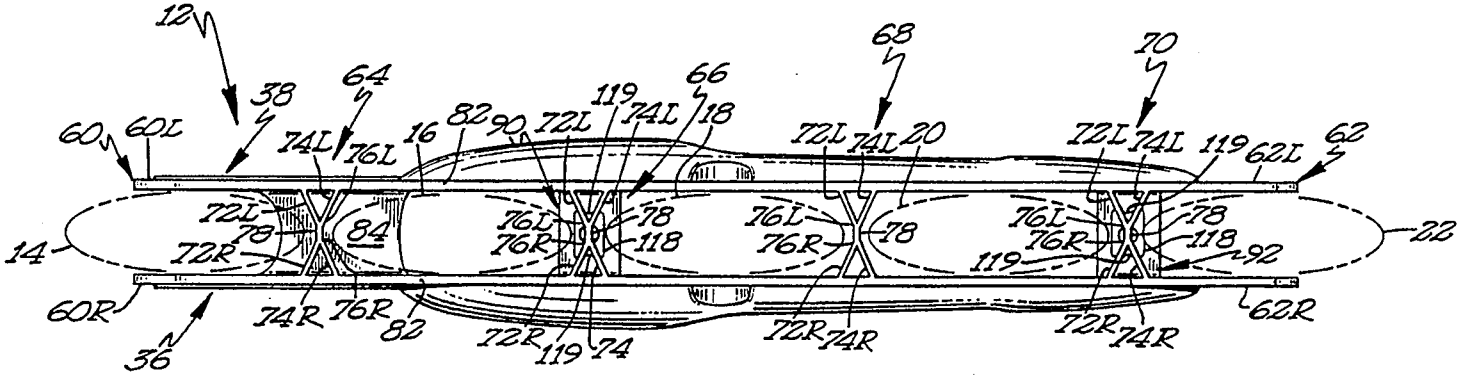
FIG. 5 is a bottom plan view of the frame of FIG. 1.

In order to provide torsional stiffness to frame 12 and to prevent energy loss due to twisting thereof during skating use, frame 12 is provided with cross-ribbing members at predetermined locations between walls 42R and 42L of side rails 36 and 38 respectively. As best seen in FIGS. 3 and 5, frame 12 includes cross-ribbing member 64 disposed between adjacent wheels 14 and 16; cross-ribbing member 66 disposed between adjacent wheels 16 and 18; cross-ribbing member 68 disposed between wheels 18 and 20; and cross-ribbing member 70 disposed between wheels 20 and 22.

Cross-ribbing members 64–70 each have substantially the same cross sectional configuration, and it will be understood that a description of one will suffice to describe the others. Generally, members 64–70 have a configuration substantially similar to an "X". Thus referring specifically to FIG. 5 and cross-ribbing member 68, each cross-ribbing member includes a first pair of riblets 72L and 74L projecting laterally inwardly from planar wall 42L towards planar wall 42R and converging at vertex 76L. Similarly, a second pair of riblets 72R and 74R project inwardly from planar wall 42R towards planar wall 42L and converge at a vertex 76R. Vertices 76R and 76L are connected to each other, and in a preferred embodiment as shown in the Figures, a connecting riblet 78 connects vertex 76R with vertex 76L. Connecting riblet 78 provides a lateral clearance space for wheels 18 and 20 that is substantially equal around the periphery of those wheels and reinforces the vertices. Each of cross-ribbing members 64–70 extends from or near the top edge 80 of planar wall 42 to the bottom edge 82 of wall 42. Each cross-ribbing member provides a resistance to twisting of the left side of frame 12 relative to the right side thereof, of the front of frame 12 relative to the rear thereof, and of the top of frame 12 relative to the bottom thereof.

Riblets 72, 74 and 78 are generally upright, and preferably vertically oriented, intersecting substantially flat, planar members. Each cross-ribbing member 64–70 thus comprises a plurality of generally upright, intersecting, planar members. In the preferred embodiment shown in the Figures, the number of intersecting members is equal to five. In addition, at several predetermined locations, each cross-ribbing member 66, 68, and 70 is supported so as to resist twisting by one or more of the planar webs 46. For example, webs **46*a* and 46*b* extend between walls 42 and 44 at right angles thereto substantially in the area where cross-ribbing member 66 extends between planar walls 42R and 42L. Webs 46*e* extend between walls 42 and 44 to torsionally stiffen member 68. Member 70, in turn, is supported by webs 46*i*, which are disposed between walls 42 and 44 adjacent member 70**.

Riblets 72L and 74L converge to form a "V" and together with side wall 42L form a triangular structure having interior angles of approximately 65°, 65° and 50°, with the 50° angle being formed at vertex 76L. Riblets 72R and 74R and wall portion 42R likewise form a similar triangular structure. Other triangular structures having different interior angles are within the purview of the present invention, however. Generally, the interior angles are partly dependent on the dimensions of the wheels. That is, as wheel width increases, the interior angle formed between the converging riblets will generally decrease. In addition, with increasing wheel width, connecting riblet 78 generally may also increase in length. The wheel 18 projects into the "V" toward the vertex 76L as shown in FIG. 5.

Further resistance to frame twisting is provided by additional torsional stiffening members. Thus, as shown in FIG. 3, frame 12 includes a forwardly disposed crossing support member 84 that extends between front fenders 60L and 60R. Support member 84 has a planar configuration and extends forwardly and downwardly from the forwardmost edge 86 of contoured walls 44R and 44L approximately half the length of fenders 60R and 60L, respectively. The forwardmost edge of member 84 has a substantially semi-circular configuration (best seen in FIGS. 3 and 5) such that it provides nearly equal clearance for wheel 14 around the periphery thereof. Member 84 engages the top of cross-ribbing member 64.

Additional torsional stiffness is provided by horizontal cross members 90 and 92 that respectively engage the tops of cross-ribbing members 64 and 68. Supporting members 84, 90 and 92 each work to inhibit the side rails 36 and 38 from flexing relative to each other. In addition, horizontal support members 90 and 92 form part of the attachment means by which frame 12 is attached to boot 26 as will be subsequently described.

Figure 4:
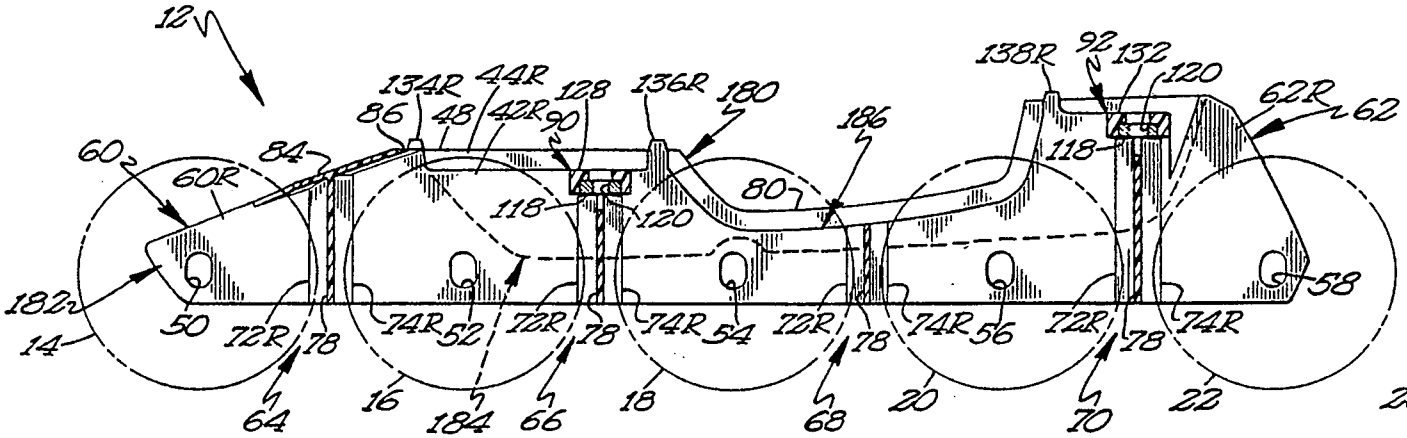
FIG. 4 is a cross sectional, side elevation view of the frame taken along cutting plane 4—4 of FIG. 3.
Figure 6:
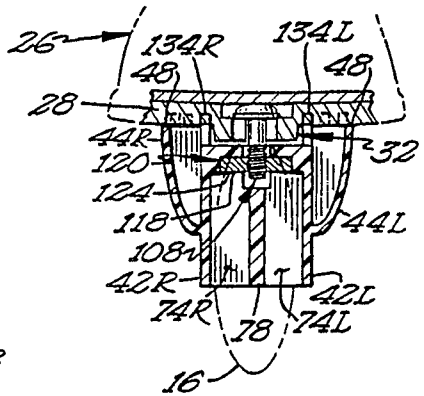
FIG. 6 is a cross sectional view of a frame and the lower portion of an attached boot taken along cutting plane 6—6 of FIG. 3.

Referring now to FIGS. 1 and 6, the means of attachment of frame 12 to boot 26 will be described. Sole 28 of boot 26 includes front and rear boot mounts 100 and 102, respectively. Because mounts 100 and 102 are substantially similar, it will be understood that a description of one will suffice as a description of the other. Thus, each mount includes a pedestal 104 projecting downwardly from boot sole 28 and includes an oval configuration bolt aperture 106 that receives a bolt 108 inserted from the interior of boot 26 such that shaft 110 extends downwardly from sole 28. Bolt 108 includes a bolt head 112 at one end that has a tool fitting 114 to receive a fastening tool such as Allen wrench 116 (FIG. 1). Bolt aperture 106 preferably has a width substantially equal to the diameter of bolt shaft 110. Its length, or its lateral extent, may vary, however, to provide the skater with the capability of adjusting the lateral position of frame 12 in relation to sole 28. Bolt shaft 110 is threaded for receipt by a threaded fastener 118 captured within horizontal support member 90 above cross-ribbing member 66. Similarly, a threaded fastener 118 is captured within horizontal support member 92 above cross-ribbing member 70. Fasteners 118 are shown in FIG. 4 and each includes a threaded aperture 120 that receives the threaded end of bolt shaft 110. Fasteners 118 are held in a non-rotational orientation within horizontal support members 90 and 92. Fasteners 118 preferably have a rectangular configuration and may include a detente or aperture that can be filled with frame material during the injection molding of the frame to aid in holding the fastener in a non-rotational orientation, though other configurations are also within the purview of the present invention.

As best seen in FIG. 6, which is an upright cross section through cross-ribbing member 66, the top 122 of fastener 118 engages the bottom surface 123 of its respective front horizontal support member 90 or 92 and the bottom surface 124 of fastener 118 is engaged by the top of cross-ribbing member 66. The engagement between rear horizontal support member 92, fastener 118 and cross-ribbing member 68 is similar to that just described. When frame 12 is attached to boot 26 the bottom surface 126 of pedestal 104 of front mount 100 will be in substantially a facial engagement with the top surface 128 of horizontal support member 90 while the bottom surface 130 of rear pedestal 104 will be substantially facially engaged with the top surface 132 of horizontal support member 92.

In many of the frames used for speed skating applications, the attachment of the frame to the boot is simply a bolt inserted through the boot sole and engaging a threaded fastener associated with the frame. The frame of the present invention, however, provides for additional means of engaging boot sole 28 to provide a more rigid frame structure. Thus, frame 12 includes a plurality of pairs of upwardly extending mounting pegs engagable in a plurality of mounting sockets disposed in boot sole 28 and forming part of mounts 100 and 102. Because one or more of the pegs will also cam in their respective mounting sockets when frame 12 is attached to sole 28, the peg and socket engagement provides additional, in the embodiment shown, six, interfaces between frame 12 and boot sole 28 that help to resist movement, including twisting, of frame 12 relative to sole 28. The camming interaction between the pegs and the sockets thus further aids in providing a torsionally stiffened frame.

In the embodiment shown, frame 12 includes three such pairs of mounting pegs, 134, 136, and 138. Mounting peg pair 134 is disposed at the intersection of contoured wall portion 44 with planar wall portion 42 at the front of frame 12. Mounting peg pair 136 is disposed slightly rearwardly of horizontal support member 90 on planar wall portion 42. Rear mounting peg pair 138 is disposed on planar wall portion 42 slightly forwardly of horizontal support member 92. Thus, each planar wall portion includes three pegs in a substantially linear arrangement. For example, mounting pegs 134R, 136R, and 138R are aligned along planar wall portion 42R. Similarly, mounting pegs 134L, 136L and 138L are in substantial linear alignment with planar wall portion 42L.

To accommodate the adjustability of frame 12 with respect to boot sole 28, the mounts 100 and 102 of boot sole 28 include several distinct pairs of mounting sockets for receipt of the frame mounting pegs as frame 12 is laterally adjusted with respect to boot sole 28. Thus, at the forward attachment 32, boot sole 28 includes three distinct socket pairs 140, 142, and 144 for receipt of mounting pegs 134 and three distinct socket pairs 146, 148, and 150 for receipt of mounting pegs 136. At rear attachment, 34 sole 28 includes two separate socket pairs 152 and 154 for receipt of mounting pegs 138. Thus, at its front attachment 32, frame 12 may be positioned in three distinct lateral positions with respect to boot sole 28 and at its rear attachment 34, frame 12 may assume two distinct lateral positions with respect to sole 28. By way of example only, boot 26 may be attached to frame 12 such that peg 134R is received by socket 140R; peg 134L is received by socket 140L; peg 136R is received by socket 146R; peg 136L is received by socket 146L; peg 138R is received by socket 152R; and peg 138L is received by socket 152L. As noted, the oval bolt aperture 106 provides a means for laterally adjusting the attachment of the frame 12 relative to the boot sole 28.

Wheels 14–22 are all mounted for rotation similar to one another, and in any way known in the art. Thus, a description of how wheel 22 is mounted will be understood to describe how wheels 14–20 may be mounted to frame 12. As seen in FIGS. 3 and 4, wheel 22 is mounted for rotation on a wheel axle 160 that comprises a bolt shaft 162 having a head 164 disposed at one end thereof and having a threaded end at the other end of shaft 162. Each axle aperture 58R and 58L receives an axle aperture plug 168 having an axle bore (not shown). After placing the aperture plugs within the axle apertures, wheel 22 is placed therebetween such that the wheel axle bore 172 and the plug axle bores are in alignment. Axle 160 is then inserted through the aligned axle bores of plugs 168 and through the wheel axle bore 172 and a threaded fastener 176 is attached to the threaded end of shaft 162.

With the embodiment shown in the Figures, applicant has provided a lightweight frame admirably useful in speed skating applications but having general applicability to all in-line roller skating uses. The embodiment shown is generally interchangeable between left and right skates, though the teachings are applicable to frames that are not interchangeable. The cross-ribbing support members provided between the planar walls of the side rails inhibit twisting of the frame. Twisting is further inhibited by the substantially horizontal, cross support members as well as the front fender crossing member, each of which integrally ties the top edges of the planar wall portions of each side rail together, as well as the mounting peg and mounting socket camming interaction. With the use of such strength enhancing and twisting force resisting measures, the synthetic frame provided by applicant can withstand the twisting forces that waste energy in speed skating applications. Synthetic materials were not used in the prior art for speed skating applications, because of the need to provide heavy, thick-walled structures to avoid torsional flexion. The skate frame embodying the present invention weighs less than six ounces—less than the lightest racing frame presently commercially available—and this lightweight frame has been provided without forfeiting the rigidity desired and found in those prior art racing skate frames.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

I claim:

1. An in-line roller skate usable by a skater on a riding surface comprising:

a plurality of wheels mounted for rotation in a common plane, each wheel being rotatably mounted by a wheel axle;

a boot including a boot sole;

a frame attached to said boot and carrying said wheel axles, said frame having top and bottom edges and including:

first and second substantially parallel side rails having a plurality of pairs of axle apertures passing therethrough to mount said axles therein; and means for providing torsional stiffness extending between said side rails at predetermined locations, said means comprising a plurality of cross-ribbing members each having a top and bottom and extending between said side rails to resist twisting of said rails by skating generated twisting forces and distribute such forces throughout said frame;

wherein at least one of said cross-ribbing members includes:

a first pair of riblets extending toward said first rail from said second rail, said first pair of riblets converging to a first vertex;

a second pair of riblets extending toward said second rail from said first rail, said second pair of riblets converging to a second vertex; and at least one connective riblet extending between said first and second vertices to connect said first and second vertices to each other.

2. The skate of claim 1 wherein at least one of said means for providing torsional stiffness further includes a horizontally disposed member extending between said rails and engaging the top of at least one said cross-ribbing member and cooperating therewith to further stiffen said frame.

3. The skate of claim 1 wherein said side rails extend forwardly of said boot and mount one of said plurality of wheels for rotation about an axis of rotation located forwardly of said boot.

4. The skate of claim 1 wherein said frame is made of a graphite filled nylon material.

5. The skate of claim 4 wherein said frame weighs less than six ounces.

6. The skate of claim 1 wherein one of said predetermined locations of said cross-ribbing members is forwardly of said boot.

7. The skate of claim 1 wherein each of said side rails includes first and second walls.

8. The skate of claim 7 wherein each of said first walls has a substantially planar configuration.

9. The skate of claim 7 wherein each of said second walls has a substantially contoured configuration.

10. The skate of claim 7 and further including a plurality of reinforcing webs extending between said first and second walls of each said side rail.

11. The skate of claim 7 wherein said first wall has a substantially planar configuration and said second wall has a substantially contoured configuration, said second wall having a bottom edge integral with said first wall and diverging outwardly and upwardly from said first wall to define a channel therebetween.

12. The skate of claim 11 and further including a plurality of reinforcing webs extending within each said channel between said first and second side walls of each said rail.

13. An in-line roller skate usable by a skater on a riding surface comprising:

a plurality of wheels mounted for rotation in a common plane, each wheel being rotatably mounted by a wheel axle;

a boot including a boot sole;

a frame attached to said boot and carrying said wheel axles, said frame having top and bottom edges and including:

first and second substantially parallel side rails having a plurality of pairs of axle apertures passing generally perpendicularly therethrough to mount said axles therein; and means for providing torsional stiffness extending between said side rails at predetermined locations, said means comprising a plurality of cross-ribbing members extending between said side rails to resist twisting of said rails by skating generated twisting forces and distribute such forces throughout said frame;

said cross-ribbing members including first and second rib portions secured to said first and second side rails, respectively, at first and second, respectively, lines of attachment on each of said first and second side rails, respectively, said first lines of attachment defining an attachment plane extending between said first and second side rails, said first and second rib portions secured together at a joinder portion disposed out of said attachment plane;

said cross-ribbing members and wheels mutually sized for a peripheral edge of a wheel to be disposed between said attachment plane and said joinder portion, said lines of attachment and said joinder portion each extending generally vertically.

14. An in-line roller skate usable by a skater on a riding surface comprising:

a plurality of wheels mounted for rotation in a common plane, each wheel being rotatably mounted by a wheel axle;

a boot including a boot sole;

a frame attached to said boot and carrying said wheel axles, said frame having top and bottom edges and including:

first and second substantially parallel side rails having a plurality of pairs of axle apertures passing therethrough to mount said axles therein; and means for providing torsional stiffness extending between said side rails at predetermined locations, said means comprising a plurality of cross-ribbing members extending between said side rails to resist twisting of said rails by skating generated twisting forces and distribute such forces throughout said frame;

wherein said cross-ribbing members are disposed between a plurality of pairs of adjacent wheels and wherein said cross-ribbing member has a transverse cross sectional configuration substantially similar to an X; including a first and second legs converging to a joinder portion;

said first and second legs secured to said first and second side rails, respectively, at first and second points of attachment in cross-section on each of said first and second side rails, respectively, said first points of attachment defining an attachment line extending between said first and second side rails, said joinder portion located out of said attachment line;

said wheels and cross-ribbing members mutually sized for a wheel disposed adjacent to a cross-ribbing member to have a peripheral edge of said wheel disposed between said attachment line and said joinder portion.

15. The skate of claim 14 wherein at least one of said means for providing torsional stiffness further includes a horizontally disposed member extending between said rails and engaging a top of at least one said cross-ribbing member and cooperating therewith to further stiffen said frame.

16. The skate of claim 14 wherein:

at least one of said cross-ribbing members comprises a first pair of riblets extending toward said first rail from said second rail, said first pair of riblets converging to a first vertex;

a second pair of riblets extending toward said second rail from said first rail, said second pair of riblets converging to a second vertex; and said first and second vertices of said first and second pairs of riblets being connected.

17. The skate of claim 16 wherein each of said side rails includes first and second walls, said frame further including a longitudinal plane about which said frame is symmetric.

18. The skate of claim 17 wherein each of said first walls has a substantially planar configuration.

19. The skate of claim 17 wherein each of said second walls has a substantially contoured configuration.

20. An in-line roller skate usable by a skater on a riding surface comprising:

a plurality of wheels mounted for rotation in a common plane, each wheel being rotatably mounted by a wheel axle;

a boot including a boot sole;

a frame attached to said boot and carrying said wheel axles, said frame having top and bottom edges and including:

first and second substantially parallel side rails having a plurality of pairs of axle apertures passing therethrough to mount said axles therein; and means for providing torsional stiffness extending between said side rails at predetermined locations, said means comprising a plurality of cross-ribbing members each having a top and bottom and extending between said side rails to resist twisting of said rails by skating generated twisting forces and distribute such forces throughout said frame;

wherein said cross-ribbing members are disposed between a plurality of pairs of adjacent wheels and wherein said cross-ribbing member has a configuration substantially similar to an X;

at least one of said cross-ribbing members comprises a first pair of riblets extending toward said first rail from said second rail, said first pair of riblets converging to a first vertex;

a second pair of riblets extending toward said second rail from said first rail, said second pair of riblets converging to a second vertex;

said first and second vertices of said first and second pairs of riblets being connected;

at least one connective riblet extending between said first and second vertices to connect said vertices to each other.

21. An in-line roller skate usable by a skater on a riding surface comprising:

a plurality of wheels mounted for rotation in a common plane, each wheel being rotatably mounted by a wheel axle;

a boot including a boot sole;

a frame attached to said boot and carrying said wheel axles, said frame having top and bottom edges and including:

first and second substantially parallel side rails having a plurality of pairs of axle apertures passing therethrough to mount said axles therein; and means for providing torsional stiffness extending between said side rails at predetermined locations, said means comprising a plurality of cross-ribbing members each having a top and bottom and extending between said side rails to resist twisting of said rails by skating generated twisting forces and distribute such forces throughout said frame;

wherein said cross-ribbing members are disposed between a plurality of pairs of adjacent wheels and wherein said cross-ribbing member has a configuration substantially similar to an X;

at least one of said cross-ribbing members comprises a first pair of riblets extending toward said first rail from said second rail, said first pair of riblets converging to a first vertex;

a second pair of riblets extending toward said second rail from said first rail, said second pair of riblets converging to a second vertex;

said first and second vertices of said first and second pairs or riblets being connected;

each of said side rails includes first and second walls, said frame further including a longitudinal plane about which said frame is symmetric; and a plurality of reinforcing webs extending between said first and second walls of each said side rail.

22. An in-line roller skate usable by a skater on a riding surface comprising:

a plurality of wheels mounted for rotation in a common plane, each wheel being rotatably mounted by a wheel axle;

a boot including a boot sole;

a frame attached to said boot and carrying said wheel axles, said frame having top and bottom edges and including:

first and second substantially parallel side rails having a plurality of pairs of axle apertures passing therethrough to mount said axles therein; and means for providing torsional stiffness extending between said side rails at predetermined locations, said means comprising a plurality of cross-ribbing members each having a top and bottom and extending between said side rails to resist twisting of said rails by skating generated twisting forces and distribute such forces throughout said frame;

wherein said cross-ribbing members are disposed between a plurality of pairs of adjacent wheels and wherein said cross-ribbing member has a configuration substantially similar to an X;

at least one of said cross-ribbing members comprises a first pair of riblets extending toward said first rail from said second rail, said first pair of riblets converging to a first vertex;

a second pair of riblets extending toward said second rail from said first rail, said second pair of riblets converging to a second vertex;

said first and second vertices of said first and second pairs of riblets being connected;

each of said side rails includes first and second walls, said frame further including a longitudinal plane about which said frame is symmetric; and said first wall has a substantially planar configuration and said second wall has a substantially contoured configuration, said second wall having a bottom edge integral with said first wall and diverging outwardly and upwardly from said first wall to define a channel therebetween.

23. The skate of claim 22 and further including a plurality of reinforcing webs extending within each said channel between said first and second walls of each said rail.

24. An in-line roller skate usable by a skater on a riding surface comprising:

a plurality of wheels mounted for rotation in a common plane, each wheel being rotatably mounted by a wheel axle;

a boot including a boot sole;

a frame attached to said boot and carrying said wheel axles, said frame having top and bottom edges and including:

first and second substantially parallel side rails having a plurality of pairs of axle apertures passing therethrough to mount said axles therein; and means for providing torsional stiffness extending between said side rails at predetermined locations, said means comprising a plurality of cross-ribbing members each having a top and bottom and extending between said side rails to resist twisting of said rails by skating generated twisting forces and distribute such forces throughout said frame;

wherein said cross-ribbing members are disposed between a plurality of pairs of adjacent wheels and wherein said cross-ribbing member has a configuration substantially similar to an X;

at least one of said cross-ribbing members comprises a first pair of riblets extending toward said first rail from said second rail, said first pair of riblets converging to a first vertex;

a second pair of riblets extending toward said second rail from said first rail, said second pair of riblets converging to a second vertex;

said first and second vertices of said first and second pairs of riblets being connected;

each of said side rails includes first and second walls, said frame further including a longitudinal plane about which said frame is symmetric;

each of said first wall of each side rail has a bottom edge and said plurality of axle aperture pairs are disposed on said first walls adjacent said first wall bottom edges, and wherein each said second wall has a second wall bottom edge, each said second wall beginning at its bottom edge above said axles mounted in said apertures and extending upwardly and outwardly from its associated said first wall.

25. The skate of claim 22 wherein the axle aperture pairs for mounting the forwardmost and rearwardmost wheels of said plurality of wheels are disposed on said first wall forwardly and rearwardly of said second wall, respectively.

26. The skate of claim 22 wherein the forwardmost and rearwardmost wheels of said plurality of wheels are mounted forwardly and rearwardly respectively of said second wall.

27. The skate of claim 22 wherein said second wall has an upper edge for bearing against said boot sole to transfer skating generated twisting forces from said frame to said boot sole and to transfer twisting forces generated at the interface between said frame and said boot sole to said frame.

28. The skate of claim 27 wherein said frame is molded from graphite filled nylon materail.

29. The skate of claim 28 wherein said frame weighs less than six ounces.

30. An in-line roller skate useable by a skater on a riding surface, said skate comprising:

a boot including a sole;

a frame attached to said sole, said frame including:

first and second longitudinally extending side rails for mounting a plurality of wheels for rotation therebetween, each of said side rails including first and second spaced apart walls;

a plurality of reinforcing webs extending between said first and second walls of each of said rails.

31. An in-line roller skate useable by a skater on a riding surface, said skate comprising:

a booting including a sole;

a frame attached to said sole, said frame including:

first and second longitudinally extending side rails for mounting a plurality of wheels for rotation therebetween, each of said side rails including first and second spaced apart walls;

said first wall has a substantially planar configuration and said second wall has a substantially contoured configuration, said second wall having a bottom edge being integral with said first wall, and diverging outwardly and upwardly from said first wall to define a channel therebetween.

32. The skate of claim 31 and further including a plurality of reinforcing webs extending within each said channel between said first and second walls of each said rail.

33. The skate of claim 31 wherein the forwardmost and the rearwardmost wheels of said plurality are mounted forwardly and rearwardly, respectively, of said second wall.

34. An in-line roller skate useable by a skater on a riding surface, said skate comprising:

a boot including a sole;

a frame attached to said sole, said frame including:

first and second longitudinally extending side rails for mounting a plurality of wheels for rotation therebetween, each of said side rails including first and second spaced apart walls;

said frame has a plurality of pairs of axle apertures and a plurality of axles carrying wheels, each axle aperture pair receiving a wheel axle that rotatable mounts a wheel of said plurality of wheels between said rails, wherein each said first wall has a bottom edge and said plurality of axle aperture paris are disposed on said first walls adjacent said first wall bottom edges, and wherein each said second wall has a second wall bottom edge, each said second wall beginning at its bottom edge above said wheel axles and extending upwardly and outwardly from its associated said first wall.

35. The skate of claim 34 wherein the axle aperture pairs for mounting the forwardmost and the rearwardmost wheels of said plurality are disposed on said first wall forwardly and rearwardly, respectively, of said second wall.

36. A light-weight frame particularly adapted for in-line roller skate speed skating, said frame resisting twisting to provide efficient energy utilization, and comprising:

first and second elongate side rails mounting therebetween a plurality of wheels for rotation in a common plane; and means for providing torsional stiffness extending between said first and second side rails; and wherein said frame is made of molded graphite-filled synthetic materail;

wherein said means include at least one cross-ribbing member having a top and comprising:

a first pair of riblets extending toward said first rail from said second rail, said first pair of riblets converging to a first vertex;

a second pair of riblets extending toward said second rail from said first rail, said second pair of riblets converging to a second vertex; and at least one connective riblet extending between said first and second vertices to connect said vertices to each other.

37. The frame of claim 36 wherein said frame mounts five wheels for rotation and said cross-ribbing member further includes a horizontally disposed member extending between said rails and engaging the top of said at least one cross-ribbing member.

38. The frame of claim 37 wherein said at least one cross-ribbing member is disposed between the second and third forwardmost wheels.

39. The frame of claim 37 wherein said at least one cross-ribbing member is disposed between the two rearwardmost wheels of said plurality of wheels.

40. The frame of claim 36 wherein said side rails each have a planar portion having bottom and top edges and said means for providing torsional stiffness comprises cross-ribbing members disposed between selected ones of adjacent wheels and wherein at least one of said cross-ribbing members has a horizontal cross-sectional configuration substantially similar to an X and wherein at least one of said cross-ribbing members extends from near said bottom edge of said planar portions to said top edge of said planar portions.

41. The frame of claim 40 wherein at least one of said cross-ribbing members includes a top and further including a horizontally disposed member extending between said rails and engaging said top of said at least one cross-ribbing member.

42. The frame of claim 41 wherein said frame is attached to a skate boot and said horizontally disposed member includes a captured fastener having a threaded aperture for receipt of a threaded bolt end to attach said frame to said skate boot.

43. The frame of claim 36 wherein said frame weighs less than six ounces.

44. An in-line roller skate useable by a skater on a skating surface, said skate comprising:

a boot, including a sole;

a frame including means for attaching said frame to said sole of said boot, said frame further including:

first and second longitudinally extending side rails, said frame including a plurality of pair of axle apertures with each side rail including one axle aperture of each said pair of axle apertures;

each said axle aperture pair receiving a wheel axle;

a plurality of wheels with a said wheel rotatably mounted on each wheel axle;

means for torsionally stiffening said frame to resist skating generated twisting forces, said means including:

at least one cross-ribbing member having:

a plurality of upright intersecting planar members extending between said side rails; and each said side rail including inner and outer side walls, said outer wall having planar and contoured portions, said inner wall integral with said outer wall at the juncture of said outer wall planar and contoured portions, and said outer wall contoured portion diverging generally upwardly and outwardly from said inner wall, said inner and outer walls each having a top edge with said outer wall top edge bearing against said sole of the skate boot when attached thereto, said inner wall cooperating with said plurality of intersecting planar members to torsionally stiffen said frame to resist skating generated twisting forces.

45. The skate of claim 44 wherein said upright planar members of at least one cross-ribbing member each have a top edge and said top edges are disposed in a common plane, and wherein said torsional stiffening means further comprises:

a planar, horizontal member intersecting said top edges of said upright members of said at least one cross-ribbing member.

46. The skate of claim 44 wherein said upright members are substantially vertical.

47. The skate of claim 44 wherein said plurality of upright members is equal to five.

48. The skate of claim 47 wherein said upright members of at least one cross-ribbing member each have a top edge and said top edges are disposed in a common plane, and wherein said torsional stiffening means further comprises:

a planar, horizontal member intersecting said top edges of said upright members of said at least one cross-ribbing member.

49. The skate of claim 44 wherein said frame further includes a plurality of strengthening webs extending between said inner and outer walls.

50. An in-line roller skate usable by a skater on a riding surface comprising:

a plurality of wheels mounted for rotation in a common plane, each wheel being rotatable mounted by a wheel axle;

a boot including a boot sole;

a frame attached to said boot, said frame having top and bottom edges and including:

first and second substantially parallel side rails having a plurality of pairs of axle apertures passing therethrough to mount said axles therein, each of said side rails including first and second walls; and means for providing torsional stiffness extending between said side rails at predetermined locations, said means comprising a plurality of cross-ribbing members extending between said side rails to resist twisting of said rails by skating generated twisting forces and to distribute such forces throughout said frame;

said cross-ribbing members including a first and second rib portions secured to said first and second side rails, respectively, at first and second, respectively, lines of attachment on said first and second side rails, respectively, with said first lines of attachment defining an attachment plane extending between said first and second side rails, said first and second rib portions secured together at a joinder portion disposed out of said attachment plane, said lines of attachment and said joinder portion each extending generally vertically;

said cross-ribbing members and wheels mutually sized for a peripheral edge of a wheel to be disposed between said attachment plane and said joinder portion.

51. The skate of claim 50 wherein each of said first walls has a substantially planar configuration.

52. The skate of claim 51 wherein each of said second walls has a substantially contoured configuration.

53. An in-line roller skate usable by a skater on a riding surface comprising:

a plurality of wheels mounted for rotation in a common plane, each wheel being rotatably mounted by a wheel axle;

a boot including a boot sole;

a frame attached to said boot, said frame having top and bottom edges and including;

first and second substantially parallel side rails having a plurality of pairs of axle apertures passing therethrough to mount said axles therein, each of said side rails including first and second walls;

means for providing torsional stiffness extending between said side rails at predetermined locations, said means comprising a plurality of cross-ribbing members each having a top and bottom and extending between said side rails to resist twisting of said rails by skating generated twisting forces and to distribute such forces throughout said frame;

each of said first walls has a substantially planar configuration; and a plurality of reinforcing webs extending between said first and second walls of said side rail.

54. An in-line roller skate usable by a skater on a riding surface comprising:

a plurality of wheels mounted for rotation in a common plane, each wheel being rotatably mounted by a wheel axle;

a boot including a boot sole;

a frame attached to said boot, said frame having top and bottom edges and including;

first and second substantially parallel side rails having a plurality of pairs of axle apertures passing therethrough to mount said axles therein, each of said side rails including first and second walls;

means for providing torsional stiffness extending between said side rails at predetermined locations, said means comprising a plurality of cross-ribbing members each having a top and bottom and extending between said side rails to resist twisting of said rails by skating generated twisting forces and to distribute such forces throughout said frame;

each of said first walls has a substantially planar configuration; and said first wall has a substantially planar configuration and said second wall has a substantially contoured configuration, said second wall having a bottom edge integral with said first wall and diverging outwardly and upwardly from said first wall to define a channel therebetween.

55. The skate of claim 54 and further including a plurality of reinforcing webs extending within each said channel between said first and second side walls of each said rail.

* * * * *

UNITED STATES PATENT AND TRADEMARK OFFICE

CERTIFICATE OF CORRECTION

PATENT NO. : 5,340,132

DATED : August 23, 1994

INVENTOR(S) : Andrzej M. Malewicz

It is certified that error appears in the above-identified patent and that said Letters Patent is hereby corrected as shown below:

Column 2, line 2, "is" should read --in--.

Column 3, line 1, "result" should read --results--.

Column 7, line 57, "attachment, 34" should read --attachment 34,--.

Column 10, line 43, delete "a" after the word "including".

Column 14, line 7, "booting" should read --boot--.

Column 14, line 40, "rotatable" should read --rotatably--.

Column 14, line 43, "paris" should read --pairs--.

Column 15, line 49, "pair" should read --pairs--.

Column 16, line 33, "rotatable" should read --rotatably--.

UNITED STATES PATENT AND TRADEMARK OFFICE

CERTIFICATE OF CORRECTION

PATENT NO. : 5,340,132

DATED : August 23, 1994

INVENTOR(S) : Andrzej M. Malewicz

It is certified that error appears in the above-indentified patent and that said Letters Patent is hereby corrected as shown below:

Column 16, line 50, delete "a" after the word "including".

Signed and Sealed this

Thirteenth Day of December, 1994

*Attest:*

Bruce Lehman

BRUCE LEHMAN

*Attesting Officer*

*Commissioner of Patents and Trademarks*